US010249282B2

(12) United States Patent
Donaldson et al.

(10) Patent No.: US 10,249,282 B2
(45) Date of Patent: Apr. 2, 2019

(54) ACTIVE NOISE REDUCTION DEVICE

(71) Applicant: SOUNDCHIP SA, Bussigny-pres-Lausanne (CH)

(72) Inventors: Mark Donaldson, Bussigny-pres-Lausanne (CH); Paul Darlington, Bussigny-pres-Lausanne (CH)

(73) Assignee: SOUNDCHIP SA, Aran-Villette (CH)

( * ) Notice: Subject to any disclaimer, the term of this patent is extended or adjusted under 35 U.S.C. 154(b) by 0 days.

(21) Appl. No.: 15/194,026

(22) Filed: Jun. 27, 2016

(65) Prior Publication Data

US 2017/0004817 A1 Jan. 5, 2017

(30) Foreign Application Priority Data

Jun. 30, 2015 (GB) ..... 1511485.3

(51) Int. Cl.
*G10K 11/178* (2006.01)
*H04R 1/10* (2006.01)

(52) U.S. Cl.
CPC ..... *G10K 11/178* (2013.01); *H04R 1/1041* (2013.01); *H04R 1/1083* (2013.01);
(Continued)

(58) Field of Classification Search
None
See application file for complete search history.

(56) References Cited

U.S. PATENT DOCUMENTS 6,625,287 B1 * 9/2003 Wurtz ..... H04R 3/002 327/110
8,532,310 B2 * 9/2013 Gauger, Jr. ..... G10L 21/0208 381/71.1

(Continued)

FOREIGN PATENT DOCUMENTS

EP 2866471 4/2015
WO 2010129241 11/2010

OTHER PUBLICATIONS

Extended European Search Report in co-pending European Patent Application No. 16173136.9, dated Nov. 18, 2016, 8 pages.

*Primary Examiner* — Curtis A Kuntz
*Assistant Examiner* — Qin Zhu
(74) *Attorney, Agent, or Firm* — Lempia Summerfield Katz LLC

(57) ABSTRACT

A method of manufacturing an Active Noise Reduction (ANR) device includes providing at a stage during manufacture a pre-completion ANR device in a non-final configuration, the pre-completion ANR device including a plurality of inputs, a plurality of signal processing resources, an output for driving an earphone driver, and a programmable switch arrangement capable of assigning any of the plurality of inputs to any of the plurality of signal processing resources, selecting from the plurality of signal processing resources a subset of signal processing resources to contribute to the output, whereby the remaining signal processing resources of the plurality do not contribute to the output in any mode of operation of the ANR device, and in a configuration step during manufacture, programming the programmable switch arrangement to assign each of at least a subset of the plurality of inputs to a different one of the selected subset of signal processing resources.

35 Claims, 9 Drawing Sheets

(52) U.S. Cl.
CPC .. *G10K 2210/1081* (2013.01); *H04R 2460/01* (2013.01); *H04R 2460/03* (2013.01)

(56) References Cited

U.S. PATENT DOCUMENTS

2002/0141599 A1* 10/2002 Trajkovic ..... G10K 11/1788 381/71.6
2008/0112570 A1* 5/2008 Asada ..... G10K 11/1782 381/71.6
2010/0272278 A1* 10/2010 Joho ..... G10K 11/178 381/71.6
2013/0259253 A1* 10/2013 Alves ..... G10K 11/1784 381/71.12
2014/0334643 A1* 11/2014 Pinna ..... H03G 3/301 381/107
2015/0010163 A1* 1/2015 Ganeshkumar ..... G10K 11/178 381/71.4

* cited by examiner

ACTIVE NOISE REDUCTION DEVICE

This application claims the benefit of GB 1511485.3, filed on Jun. 30, 2015, which is hereby incorporated by reference in its entirety.

FIELD

The disclosed embodiments relate to an Active Noise Reduction (ANR) device and a method of manufacturing an ANR device.

BACKGROUND

Active Noise Reduction (ANR) systems, particularly active control systems for headphones and earphones, are well known in the art. ANR techniques offer the capability to cancel (at least some useful portion of) unwanted external sound via feedforward control and/or to cancel excess pressures generated in the blocked (or "occluded") ear canal during speech ("occlusion effect") via feedback control.

ANR systems in the art are typically optimised for a particular architectural configuration according to one of a number of available choices of controlling topologies and processing technologies (e.g. analogue or digital). The architecture is internally defined by the internal hardwiring of the device and the processing is defined by the technology implemented in the device.

Typically ANR systems in the art vary in complexity, performance and power consumption depending upon the application for which they are designed. A manufacturer may have to produce a range of different devices to satisfy the needs of their customer base, with a variety of different technologies being implemented over the range of devices.

SUMMARY AND DESCRIPTION

The scope of the present invention is defined solely by the appended claims and is not affected to any degree by the statements within this summary.

The present embodiments may overcome or at least alleviate one or more of the drawbacks or limitations in the related art. For example, the disclosed embodiments may provide an alternative ANR design that overcomes or at least alleviates limitations of the prior art.

In accordance with a first aspect, there is provided a method of manufacturing an Active Noise Reduction (ANR) device (e.g. ANR earphone apparatus or ANR module (e.g. ANR amplifier module) for use with earphone apparatus), including: providing at a stage during manufacture a pre-completion ANR device in a non-final configuration (e.g. unconfigured ANR device), the pre-completion ANR device including (e.g. for each stereo or binaural channel): a plurality of inputs; a plurality of (e.g. fixed function) signal processing resources; an output for driving an earphone driver; and a programmable switch arrangement capable of assigning any of the plurality of inputs to any of the plurality of signal processing resources; selecting from the plurality of signal processing resources a subset of signal processing resources to contribute to the output, whereby the remaining signal processing resources of the plurality do not contribute to the output in any mode of operation of the ANR device; and in a configuration step during manufacture, programming the programmable switch arrangement to assign (e.g. uniquely assign) each of at least a subset of the plurality of inputs to a different one of the selected subset of signal processing resources.

In this way, a method of manufacturing an ANR device (e.g. method of configuring an ANR device during manufacture) is provided in which different configurations of device may be readily produced from a common device design during final stages of manufacture by enabling a selected subset of a superset of signal processing resources to contribute to the output (e.g. contribute in at least one mode of operation of the device) with unselected signal processing resources being prevented from contributing to the output (i.e. non-enabled) in the final product. Advantageously, the configuration step may be varied from one batch of ANR devices to another to meet different specification requirements for the ANR device (e.g. varied based on functional demands, noise-cancelling performance, power implications, additional component/manufacturing cost or local market requirements).

Typically the ANR device includes at least one audio input operative to receive an audio signal (e.g. audio material input signal or voice input signal) and the ANR device is configured to combine the audio signal with an output from one or more of the plurality of signal processing resources to produce a final output signal.

In one embodiment, the plurality of signal processing resources includes a plurality of filters (e.g. plurality of active filter circuits). In one embodiment, the plurality of filters include at least one analogue filter (e.g. two or more analogue filters) and at least one digital filter (e.g. two or more analogue filters). Each of the plurality of filters may be configurable as an ANR filter or another type of filter (e.g. after the filter has been assigned to an input).

In one embodiment, the signal processing resources are enabled to contribute to the output by activating the resource (e.g. powering the resource) or by enabling the input assigned thereto (e.g. by allowing a user access to the input or, in the case of a microphone input, connecting a microphone (e.g. sensing microphone) to the microphone input during manufacture).

In one embodiment, the signal processing resources are non-enabled by deactivating the resource (e.g. omitting to assign the resource to an input or powering down the resource) or non-enabling the input assigned thereto (e.g. preventing user access to the input or, in the case of a microphone input, omitting to connect a microphone to the microphone input during manufacture).

In one embodiment, the method includes carrying out the recited method steps to manufacture a first ANR device (or first batch of ANR devices) with a first configuration and repeating the method steps to manufacture a second ANR device (or second batch of ANR devices) with a second configuration different to the first. The differing first and second configurations may be achieved by varying one or more of: the selection of subsets of signal processing resources, configuration of selected signal processing resources, assignment of inputs, configuration of the switch arrangement.

In one embodiment, the ANR device includes a controller for programming the switch arrangement. The controller may include an input to allow the configuration of the switch arrangement set by the controller to be varied (e.g. by the manufacturer).

In one embodiment, the switch arrangement includes a matrix switch (e.g. audio matrix switch). Typically the matrix switch will is programmable to route any of n inputs to any of m outputs.

In one embodiment, the matrix switch is an analogue matrix switch (e.g. analogue audio matrix switch), e.g. implemented using FET passgates or similar audio switch technologies. In another embodiment, the matrix switch is a digital matrix switch (e.g. digital audio matrix switch), e.g. implemented by a software module.

In one embodiment, the switch arrangement is reprogrammable.

In another embodiment, the programmable switch arrangement is configured to be programmable once (e.g. one-time programmable) on manufacture of the ANR device (e.g. to permanently set the connection of the selected assignment of inputs to signal processing resources).

In one embodiment, the plurality of inputs include at least one analogue input (e.g. two or more analogue inputs) and the plurality of signal processing resources include at least one analogue signal processing resource (e.g. two or more analogue signal processing resources).

In one embodiment, the plurality of inputs include (e.g. further include) at least one digital input (e.g. two or more digital inputs) and the plurality of signal processing resources include at least one digital signal processing resource (e.g. two or more digital signal processing resources).

In one embodiment, the output of the plurality of signal processing resources (e.g. output of the at least one analogue signal processing resource and the at least one digital signal processing resource) are summed to form a single output (e.g. to form a multiple input/single output structure).

In one embodiment, the plurality of inputs include at least one microphone input (e.g. for receiving a signal input from a sensing microphone (e.g. feedforward or feedback microphone)). The method may include enabling the microphone input by connecting a microphone (e.g. first sensing microphone) to the microphone input during manufacture (e.g. as part of the configuration step). The method may further include enabling a further microphone input by connecting a further sensing microphone to the further microphone input during manufacture (e.g. also as part of the configuration step). In this way, a hybrid feedforward/feedback ANR device may be provided using the plurality of inputs.

In one embodiment, the plurality of signal processing resources includes one or more of: a plurality of analogue signal processing resources; and a plurality of digital signal processing resources.

In one embodiment, the plurality of inputs include one or more of: a plurality of analogue inputs; and a plurality of digital inputs.

In one embodiment, the plurality of analogue inputs include at least two analogue microphone inputs. In one embodiment, the plurality of analogue inputs further include at least one analogue audio input.

In one embodiment, the plurality of digital inputs include at least two digital microphone inputs. In one embodiment, the plurality of digital inputs further include at least one digital audio input.

In one embodiment, the method includes manufacturing a plurality of different configurations of ANR device. For example, the pre-completed ANR device may be configurable during manufacture between a low power consumption configuration and a high performance (e.g. higher power consumption) configuration.

In one embodiment, for a first class of ANR device (e.g. low power consumption device): the selecting step includes selecting one or more of the plurality of analogue signal processing resources to contribute to the output and one or more of the plurality of digital signal processing resources to not contribute to the output (e.g. with an available digital filter unassigned to an input or non-enabled if assigned to an input); and the configuration step includes (uniquely) assigning a subset of the plurality of the analogue inputs to the selected one or more of the plurality of analogue signal processing resources.

In one embodiment, for a second class of ANR device (e.g. high performance/high power consumption device): the selecting step includes selecting one or more of the plurality of digital signal processing resources to contribute to the output and one or more of the plurality of analogue resources to not contribute to the output (e.g. with an available analogue filter unassigned to an input or non-enabled if assigned to an input); and the configuration step includes (uniquely) assigning a subset of the plurality of digital inputs to the selected one or more of the plurality of digital signal processing resources.

In one embodiment, for the first class of ANR device the configuration step includes assigning an analogue feedforward microphone input to a selected analogue signal processing resource and the selected analogue signal processing resource is configured to operate as a feedforward ANR filter.

In one embodiment, for the first class of ANR device the configuration step includes assigning an analogue feedback microphone input to a selected analogue signal processing resource and the selected analogue signal processing resource is configured to operate as a feedback ANR filter.

In one embodiment, for the first class of ANR device the configuration step includes assigning an analogue audio input to a selected analogue signal processing resource and the selected analogue signal processing resource is configured to operate as an equalisation filter.

In one embodiment, for the second class of ANR device the configuration step includes assigning a digital feedforward microphone input to a selected digital signal processing resource and the selected digital signal processing resource is configured to operate as a feedforward ANR filter. The configuration step may further include assigning an analogue feedback microphone input to a selected analogue signal processing resource and the selected analogue signal processing resource is configured to operate as a feedback ANR filter. In this way, a hybrid feedforward/feedback ANR device may be provided with the feedforward control advantageously implemented digitally whilst the feedback control is advantageously implemented in the analogue domain.

In one embodiment, for the second class of ANR device the configuration step includes assigning a digital audio input to a selected digital signal processing resource and the selected digital signal processing resource is configured to operate as an equalisation filter.

In one embodiment, the method further includes configuring the ANR device to power down or substantially reduce power to signal processing resources that are not selected to contribute to the output.

In one embodiment, the ANR device is operative to provide a resource sharing output signal to an external device operative to provide an external signal processing resource (e.g. external signal processing resource such as an ANR filtering or equalisation resource). In this way, the ANR device may take advantage of resource sharing opportunities (e.g. to further reduce power consumption of the device).

In one embodiment, the switching arrangement is operative to provide the resource sharing output signal to the external device. In one embodiment, the resource sharing output signal is provided is via a dedicated output. In another embodiment, the resource sharing output signal is provided using one of the plurality of inputs. In one embodiment, the switching arrangement is programmable to assign one or more of the plurality of inputs as an output for the resource sharing output signal.

In another embodiment, the plurality of signal processing resources is expandable to include an external signal processing resource assignable to an input by the switch arrangement.

In one embodiment, the programmable switching arrangement includes at least one DAC or ADC device to convert signals between digital and analogue form, the method further including selecting one or more of the at least one DAC or ADC device for operation during the configuration step.

In one embodiment, the method further includes configuring the ANR device to power down or substantially reduce power to any unselected one of the at least one DAC or ADC device.

In the case of a plurality of inputs including at least one digital microphone input (feedforward or feedback microphone), the or each digital microphone input may include an interface circuit to support direct connection to a microphone.

In one embodiment, the method further includes configuring the ANR device to power down or substantially reduce power to the interface circuit of any unselected one of the at least one digital microphone input.

In one embodiment, the plurality of inputs include at least one command input operative to receive a command signal.

In accordance with a second aspect, there is provided an Active Noise Reduction (ANR) device including: a plurality of inputs; a plurality of (fixed function) signal processing resources; an output for driving an earphone driver; a programmable switch arrangement capable of assigning any of the plurality of inputs to any of the plurality of signal processing resources; and a controller for programming the switch arrangement in order to assign (e.g. uniquely assign) each of at least a subset of the plurality of inputs to a different one of the signal processing resources.

In this way, an ANR device is provided in which any of the plurality of signal processing resources can be enabled and assigned to any of the plurality of inputs.

In one embodiment, the ANR device is dynamically configurable to vary which signal processing resources are selected to contribute to the output. For example, the controller may in use be operative to reconfigure the switch arrangement between at least first and second modes of operation (e.g. between high power and low power consumption modes) to vary assignment of signal processing resources to the plurality of inputs. In this way, the device may be configured to operate such that the instantaneous requirements of the system are best met. This allows the device to respond (e.g. automatically) to, for example, requirements to switch to a low-power mode in situations in which a batter power source is failing.

In one embodiment (and consistent with the first aspect), the ANR device is configured such that only a subset of signal processing resources is selected during manufacture to contribute to the output and the remaining signal processing resources of the plurality do not contribute to the output in any mode of operation of the ANR device. In this way, the ANR device may be configured by a manufacturer to provide a subset of signal processing resources to suit a particular specification. Once configured by the manufacturer, the ANR device may still be dynamically configurable to vary which signal processing resources are selected from the subset of signal processing resources selected during manufacture to contribute to the output. For example, the controller may in use be operative to reconfigure the switch arrangement between at least first and second modes of operation (e.g. between high power and low power consumption modes) to vary assignment of signal processing resources to the plurality of inputs based on the (enabled) selected subset of signal processing resources.

In one embodiment, the ANR device is dynamically configurable so as to minimise a (e.g. single-valued) "figure-of-merit" or "cost-function" parameter. Such a cost function can be constructed as a metric indicating the notional "cost" associated with each device configuration, including elements from any measurand of interest to the system designer. Such measurands will typically include instantaneous current drain (i.e. short-term power consumption). Dynamic configuration may then proceed according to the minimisation of this cost function.

In one embodiment, the ANR device includes at least one audio input operative to receive an audio signal (e.g. audio material input signal or voice input signal) and the ANR device is configured to combine the audio signal with an output from one or more of the plurality of signal processing resources to produce a final output signal.

In one embodiment, the plurality of signal processing resources includes a plurality of filters (e.g. plurality of active filter circuits). In one embodiment, the plurality of filters include at least one analogue filter (e.g. two or more analogue filters) and at least one digital filter (e.g. two or more analogue filters).

In one embodiment, the signal processing resources are enabled to contribute to the output by activating the resource (e.g. powering the resource) or by enabling the input assigned thereto (e.g. by allowing a user access to the input or, in the case of a microphone input, connecting a microphone (e.g. sensing microphone) to the microphone input during manufacture).

In one embodiment, the signal processing resources are non-enabled by deactivating the resource (e.g. omitting to assign the resource to an input or powering down the resource) or non-enabling the input assigned thereto (e.g. preventing user access to the input or, in the case of a microphone input, omitting to connect a microphone to the microphone input during manufacture).

In one embodiment, the switch arrangement includes a matrix switch (e.g. audio matrix switch). Typically the matrix switch will is programmable to route any of n inputs to any of m outputs.

In one embodiment, the matrix switch is an analogue matrix switch (e.g. analogue audio matrix switch), e.g. implemented using FET passgates or similar audio switch technologies. In another embodiment, the matrix switch is a digital matrix switch (e.g. digital audio matrix switch), e.g. implemented by a software module.

In one embodiment, the switch arrangement is reprogrammable.

In another embodiment, the programmable switch arrangement is configured to be programmable once (e.g. one-time programmable) on manufacture of the ANR device (e.g. to permanently set the connection of the selected assignment of inputs to signal processing resources).

In one embodiment, the plurality of inputs include (e.g. for each stereo or binaural channel) at least one analogue input (e.g. two or more analogue inputs) and the plurality of signal processing resources include at least one analogue signal processing resource (e.g. two or more analogue signal processing resources).

In one embodiment, the plurality of inputs include (e.g. further include for each stereo or binaural channel) at least one digital input (e.g. two or more digital inputs) and the plurality of signal processing resources include at least one digital signal processing resource (e.g. two or more digital signal processing resources).

In one embodiment, the output of the plurality of signal processing resources (e.g. output of the at least one analogue signal processing resource and the at least one digital signal processing resource) are summed to form a single output (e.g. to form a multiple input/single output structure for each stereo or binaural channel).

In one embodiment, the plurality of inputs include (e.g. for each stereo or binaural channel) at least one microphone input (e.g. for receiving a signal input from a sensing microphone (e.g. feedforward or feedback microphone)) and the ANR device further includes a microphone (e.g. first sensing microphone) connected to the microphone input. In one embodiment, the plurality of inputs include (e.g. for each stereo or binaural channel) a further microphone input and the ANR device includes a further microphone connected to the further microphone input. In this way, a hybrid feedforward/feedback ANR device may be provided using the plurality of inputs.

In one embodiment, the plurality of signal processing resources includes one or more of: a plurality of analogue signal processing resources; and a plurality of digital signal processing resources.

In one embodiment, the plurality of inputs include one or more of: a plurality of analogue inputs; and a plurality of digital inputs.

In one embodiment, the plurality of analogue inputs include (e.g. for each stereo or binaural channel) at least two analogue microphone inputs. In one embodiment, the plurality of analogue inputs further include (e.g. for each stereo or binaural channel) at least one analogue audio input.

In one embodiment, the plurality of digital inputs include (e.g. for each stereo or binaural channel) at least two digital microphone inputs. In one embodiment, the plurality of digital inputs further include (e.g. for each stereo or binaural channel) at least one digital audio input.

In a first class of ANR device (e.g. low power consumption device), the ANR device is configured such that (e.g. for each stereo or binaural channel) one or more of the plurality of analogue signal processing resources contribute to the output and one or more of the plurality of digital signal processing resources do not contribute to the output (e.g. with an available digital filter unassigned to an input or non-enabled if assigned to an input), whereby a subset of the plurality of the analogue inputs are (uniquely) assigned to the selected one or more of the plurality of analogue signal processing resources.

In one embodiment, the selected analogue signal processing resource is configured as a feedforward ANR filter and the assigned input is an analogue feedforward microphone input.

In one embodiment, the selected analogue signal processing resource is configured as an analogue feedback ANR filter and the assigned input is an analogue feedback microphone input.

In one embodiment, the selected analogue signal processing resource is configured as an equalisation filter and the assigned input is an analogue audio input.

In a second class of ANR device (e.g. high performance/high power consumption device), the ANR device is configured such that (e.g. for each stereo or binaural channel) one or more of the plurality of digital signal processing resources contribute to the output and one or more of the plurality of analogue resources do not contribute to the output (e.g. with an available analogue filter unassigned to an input or non-enabled if assigned to an input), whereby a subset of the plurality of digital inputs are (uniquely) assigned to the selected one or more of the plurality of digital signal processing resources.

In one embodiment, the selected digital signal processing resource is configured as a feedforward ANR filter and the assigned input is a digital feedforward microphone input. In one embodiment, there is further selected an analogue signal processing resource configured as an analogue feedback ANR filter and assigned to an analogue feedback microphone input.

In one embodiment, the selected digital signal processing resource is configured as an equalisation filter and the assigned input is a digital audio input.

In one embodiment, the ANR device is configured to power down or substantially reduce power to signal processing resources that are not selected to contribute to the output.

In one embodiment, the ANR device is operative to provide a resource sharing output signal to an external device operative to provide an external signal processing resource (e.g. external signal processing resource such as an ANR filtering or equalisation resource).

In one embodiment, the switching arrangement is operative to provide the resource sharing output signal to the external device. In one embodiment, the resource sharing output signal is provided is via a dedicated output. In another embodiment, the resource sharing output signal is provided using one of the plurality of inputs. In one embodiment, the switching arrangement is programmable to assign one or more of the plurality of inputs as an output for the resource sharing output signal.

In another embodiment, the plurality of signal processing resources is expandable to include an external signal processing resource assignable to an input by the switch arrangement.

In one embodiment, the programmable switching arrangement includes at least one DAC or ADC device to convert signals between digital and analogue form.

In one embodiment, the ANR device is configured to power down or substantially reduce power to any unselected one of the at least one DAC or ADC device.

In the case of a plurality of inputs including at least one digital microphone input (feedforward or feedback microphone), the or each digital microphone input may include an interface circuit to support direct connection to a microphone.

In one embodiment, the ANR device is configured to power down or substantially reduce power to the interface circuit of any unselected one of the at least one digital microphone input.

In one embodiment, the plurality of inputs include at least one command input operative to receive a command signal.

DETAILED DESCRIPTION

Described herein are methods and devices directed to the concept of constructing an ANR device from a new type of configurable device having architectural and processing resources for active control which are uncommitted at the time of manufacture. Unlike ANR devices familiar from the prior art, the inputs of the disclosed ANR devices are not uniquely hard-wired to internal processing resources; rather, it is possible to assign the inputs to the processing resources as best matches the demands of a particular application to which the device is targeted. This assignment is made through a flexible, programmable switching scheme and allows the device to be optimised for different applications, characterised by different balances of cost/power consumption/system functionality.

Figure 1:
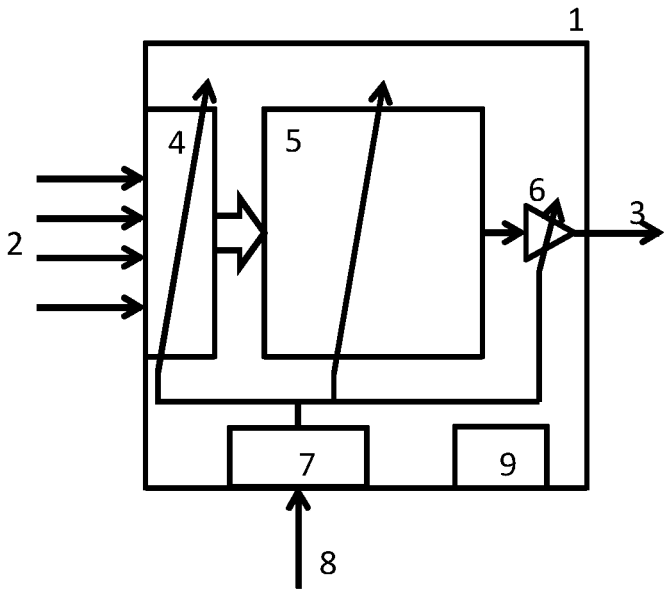
FIG. 1 is a schematic illustration of an ANR device in accordance with a first embodiment prior to configuration during manufacture.

FIG. 1 shows a simplified example of a configurable device 1 operating upon a plurality of inputs 2 to produce the single output 3 for driving an earphone (for simplicity only one channel of a stereo or binaural pair of channels is illustrated and discussed). The inputs 2 are coupled to a plurality of signal processing resources 5 (configurable filters) by programming a switching array 4 which maps the inputs to the plurality of signal processing resources 5, the output of which is the system response 3 (i.e. the control signal which drives the earphone actuator). The control signal is provided at appropriate amplitude and impedance by an amplifier 6, whose gain, along with the other configurable parameters of the system, is under the control of the supervisory block 7, which itself may respond to external control and programming inputs 8. The device will include other power and housekeeping functions 9.

During manufacture a subset of the plurality of signal processing resources 5 is selected to contribute to the output of the device based on a design specification. Unselected signal processing resources are non-enabled so as to not contribute to the output of the device in any modes of operation. The selected signal processing resources are mapped to a subset of the plurality of inputs 2 in a one-to-one relationship via switching array 4 using supervisory block 7. Supervisory block 7 is additionally utilised to configure the selected signal processing resources to operate as desired filter types (e.g. feedforward, feedback or equalisation filters depending upon the type of input and the requirements of the specification). Advantageously, device 1' allows a range of differently specified ANR devices to be manufactured from a common device platform.

Figure 2:
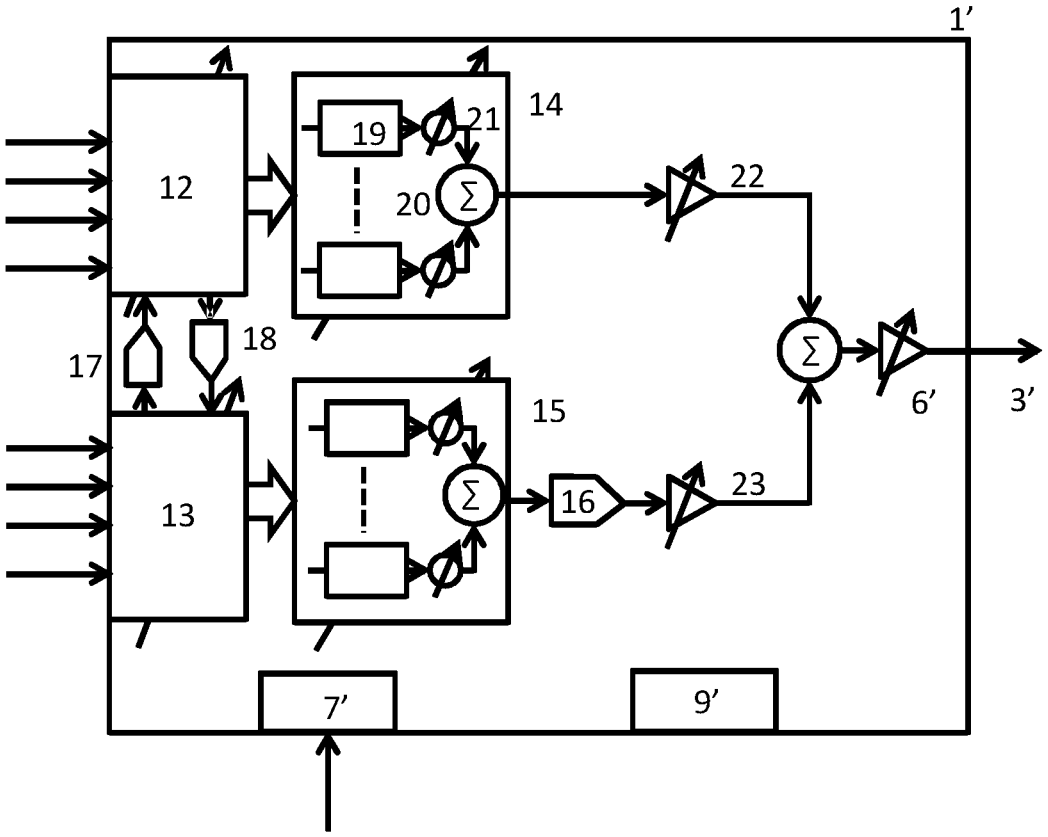
FIG. 2 is a schematic illustration of an ANR device accordance with a second embodiment prior to configuration during manufacture.

FIG. 2 shows a more advanced device 1' based on device 1 (features in common are labelled accordingly) that operates on first and second pluralities of inputs 10, 11 to produce the single output 3'. The first plurality of inputs 10 is a set of analogue signals whilst the second plurality of inputs 11 is a set of digital signals. Each of the first plurality of inputs 10, being an analogue signal, can only properly be processed directly by analogue means. Thus first plurality of inputs 10 is mapped through switching array 12 to a set of analogue processing resources 14. Similarly, the second plurality of inputs 11 is handled by its own switching array, 13 and processing resources 15. The output of the digital processing block 15 is converted to an analogue signal by a digital to analogue converter 16 before the weighted sum of the analogue and digital paths form the single (analogue) control output 3'.

The device as described introduces a divide between the two "formats" of analogue and digital. In some circumstances, it could be advantageous for a signal available in one format to be processed on a processing resource native to the other. This is provided by the introduction of data converters 17, 18 between the input switching arrays. A digital to analogue converter (DAC) 17 allows information encoded on a digital input to be applied to processing resources available in the analogue block, whilst conversely an analogue to digital converter (ADC) 18 allows analogue signals to be digitally processed.

Each of the analogue and digital processing blocks 14, 15 shares a common basic architecture. Each consists of a series of programmable filters 19, which are summed at processing block 20 to form a single output, giving the block a multiple-input, single-output structure. Both the analogue and digital blocks 14, 15 have at least two inputs. It is the function of the switching arrays 12, 13 to populate these inputs appropriately, with signals from the input array. The summation at the end of each of the processing block 20 is an explicit weighted sum 21.

In order to better manage gain distribution within a practical implementation of the device, a further pair of amplifiers and/or attenuators 22, 23 may extend the implementation of the weighted sum to the input of the final output amplifier 6'.

Device 1' is configurable for the purpose of optimising the noise cancelling performance of any product or system in which it is applied, the total cost of any system in which it is applied (where "cost" may be understood in terms of Bill-of-Materials, manufacturing and configuration cost, etc.) and the total power consumption of any system in which it is applied. In order to optimise power consumption, elements of the device not used in any configuration are capable of being powered down, to reduce power drain. Such elements include the ADC and DAC 17, 18 between the input switching arrays and elements of the input switching arrays 12, 13 and the analogue processing resources 14.

Analogue processing block 14 includes a series of parallel filter paths, each of which potentially includes active circuits, which may consume power when not in use 32.

The input switching arrays include interface circuits to support direct connections to microphones. These are provided in the digital switching array 33 to support the interface to digital microphones 34. The analogue switching array similarly includes interface circuits 35 specific to conventional analogue microphones 36. In both cases—though particularly in the case of the digital microphones and their interfaces—powering down these sub-systems when not required represents a considerable and attractive power saving.

Figure 2A:
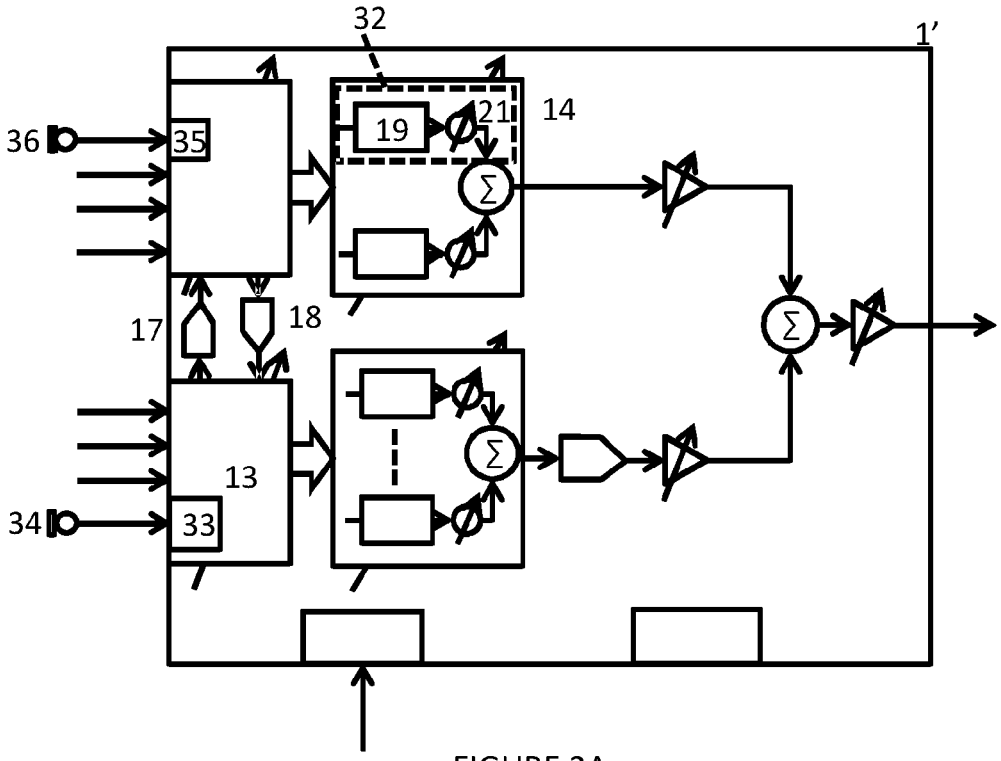
FIG. 2A is a schematic illustration of a first configuration of an ANR device formed from the unconfigured ANR device of FIG. 2.

The system of FIG. 2A shows (one channel of) an application of device 1' applied to a simple hybrid (i.e. feedforward and feedback) noise cancelling earphone application in which an analogue microphone 36 provides a signal for feedback control via analogue microphone input 35 and a digital microphone 34 provides a signal for feedforward control via digital microphone input 33. Analogue microphone input 35 is routed for filtering by programmable analogue filter 19A. Digital microphone input 34 is routed for filtering by programmable digital filter 19B.

Figure 2B:
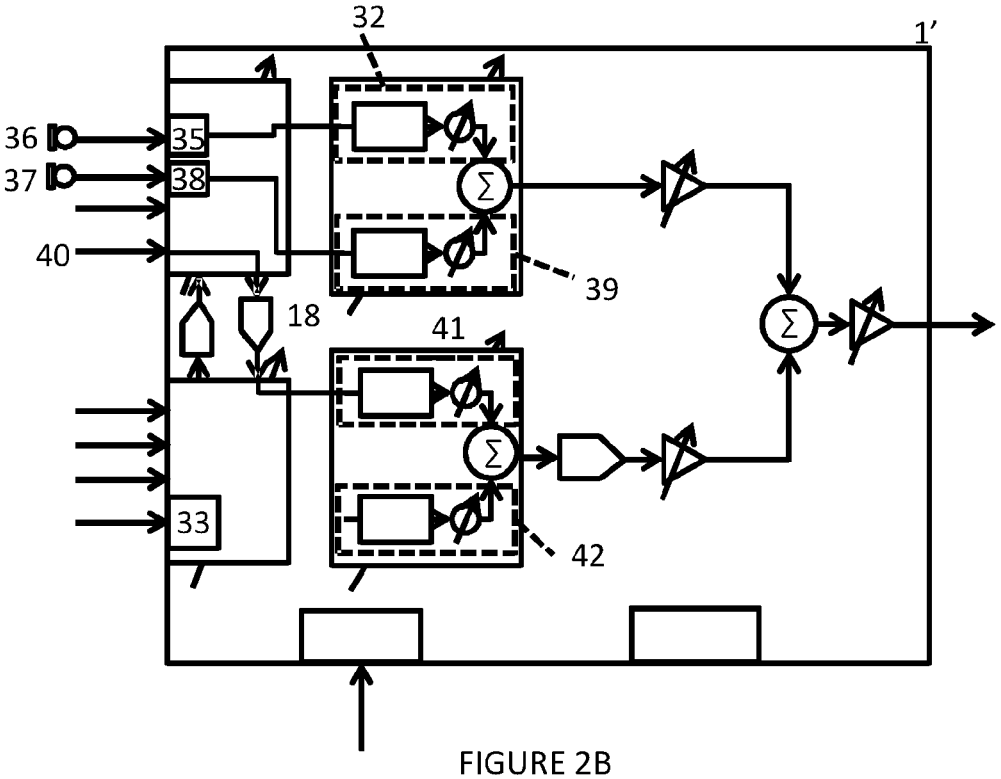
FIG. 2B is a schematic illustration of a second configuration of an ANR device formed from the unconfigured ANR device of FIG. 2.

The system of FIG. 2B shows an application of the newly-disclosed device applied to a simple hybrid (i.e. feedforward and feedback) noise cancelling headphone application, in which analogue technology is used in pursuit of low overall system power consumption. Two analogue microphones 36, 37 provide the observation required for feedback and feedforward control, with the signals entering the newly-disclosed device at the analogue array's analogue microphone inputs 35, 38 and being routed to the two analogue processing channels 32, 39, where the two control signal components are designed.

Audio program material enters the device as an analogue signal at 40 and is routed from the analogue input through the data converter 18 into the digital switching array, from where it is further routed to the digital processing block, where one of the filtering paths 41 applies compensation/equalisation. Notice that the other block in the digital path 42 is implemented on a numerical machine and there is little meaning in "powering it down", despite the fact that it is not being used in this application. The digital microphone interface 33 on the other hand is explicitly powered down.

Figure 2C:
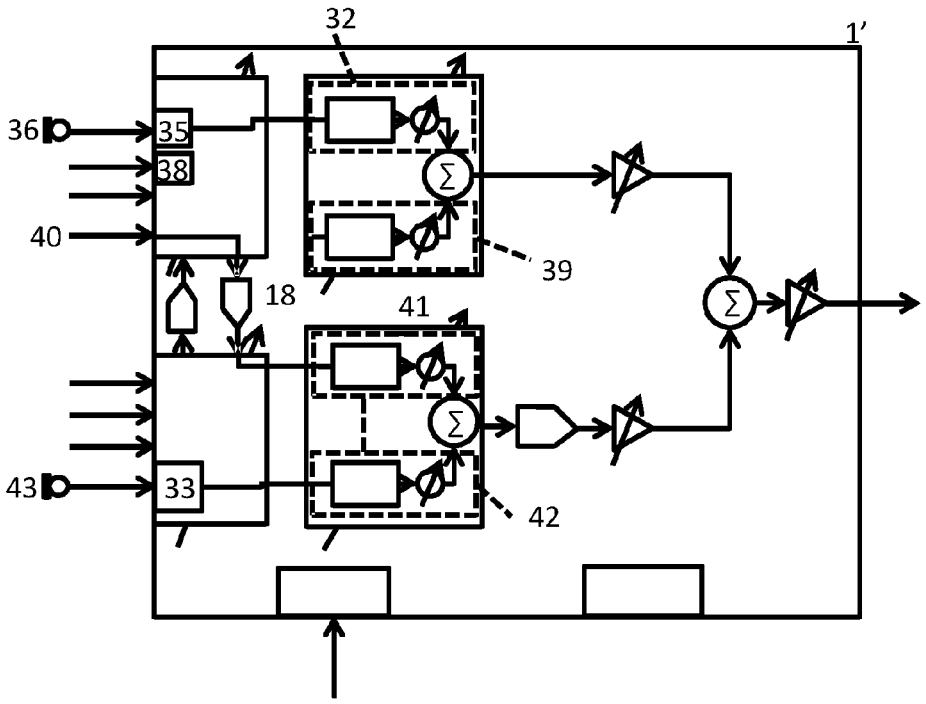
FIG. 2C is a schematic illustration of a third configuration of an ANR device formed from the unconfigured ANR device of FIG. 2.

The same device applied to a different target product, in which the highest possible hybrid noise cancelling performance is sought—even at the expense of higher power consumption—may be configured differently, as suggested in FIG. 2C. In the application of FIG. 2C, the feedback noise reduction has been retained, but the higher differential order filtering possible with digital filtering has been exploited in the feedforward path. This has motivated the removal of an analogue microphone and the powering down of both its interface 38 and the analogue processing block 39, which was filtering the feedforward signal. The analogue microphone is replaced by a digital microphone 43 on the now powered-up interface 33, whose output is fed to the second digital filter path 42. Notice that the availability of a digital audio stream would allow the power hungry data converter 18 to be turned off.

Assignment of signals from the input "array" to the processing resources is made at the time of configuration during manufacture. This assignment is made with reference to the requirements of the application, bearing in mind the functional demands of the application and the power implications of selecting any resource. For example, a low-cost product which is expected to draw low power from its battery might be forced to implement feedforward noise cancellation using a low-power analogue microphone, providing a signal which is filtered to relatively low levels of complexity by an analogue filter, itself consuming low power. However, application in a more exacting product may justify the specification of a more expensive and power-hungry digital microphone, whose signal is operated upon by a digital filter, able to operate at higher differential order and thereby able to deliver more complete noise cancellation. This flexibility of matching resources to application requirement across a wide range of target applications is not possible with prior art "off the shelf" noise cancelling devices. However, there is a further aspect of the disclosed device, which extends its flexibility still further.

In addition to the ability to dispose the information gathered from the sensor inputs between the processing resources available on the device, as discussed above, it is an intended feature of the newly-disclosed device that it is further capable of exploiting processing resources located external to itself. By this means, an entire noise cancelling system may make use of processing means available on nearby sub-systems, in a resource-sharing strategy. This allows, for example, the entire system's power consumption to be optimised in an application where processing resources are at risk of duplication. It also allows a degree of future-proofing for the present device, allowing it to take advantage of resources which are not available—or conceived of—at the time of its design.

This resource sharing strategy is best exemplified in the case of a wireless headphone, in which the newly-disclosed device is enabling the headphone in concert with a Bluetooth or similar wireless Codec. Such a Codec often is capable of digital filtering, which can be exploited to serve duty in any of the audio, monitor or feedforward roles made possible by the signal routing flexibility of the newly-disclosed device.

Figure 2D:
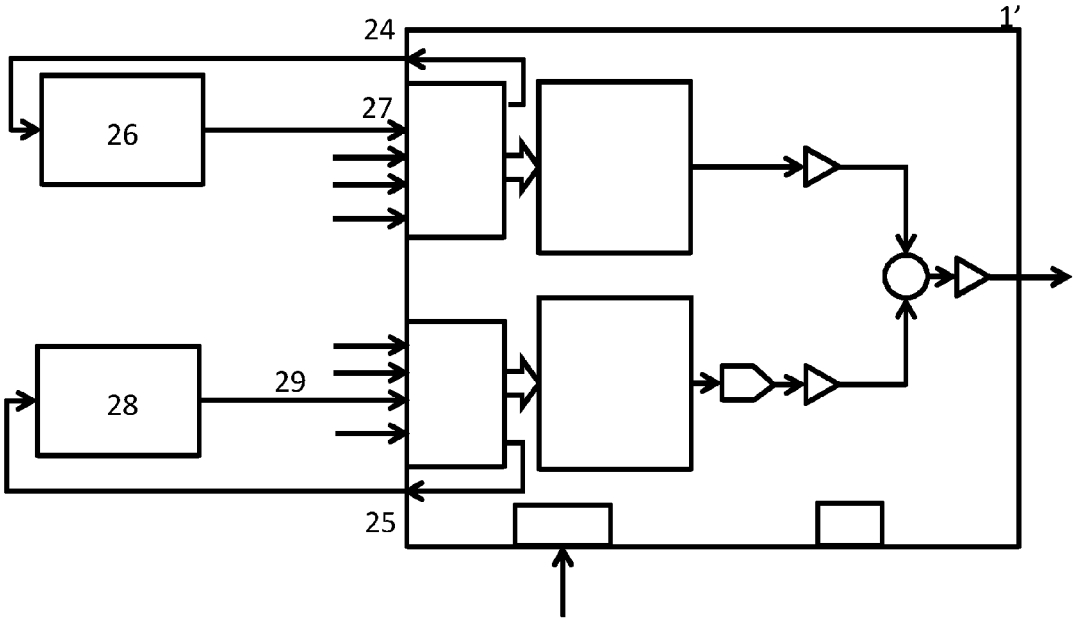
FIG. 2D is a schematic illustration of a fourth configuration of an ANR device formed from the unconfigured ANR device of FIG. 2.

As illustrated in FIG. 2D, in order to support the distribution of sensor information to remote processing resources, input switching arrays 10, 11 may provide outputs 24, 25 from the device for connecting processing means 26, 28 on remote resources. Results from remote processing resources are coupled back into the input vector of the device. Remote analogue processors 26 operating on the signal derived from 24 are typically themselves analogue signals and are fed back to an analogue input 27. Similarly for a digital remote processor 28 returning its result to a digital input 29.

Figure 2E:
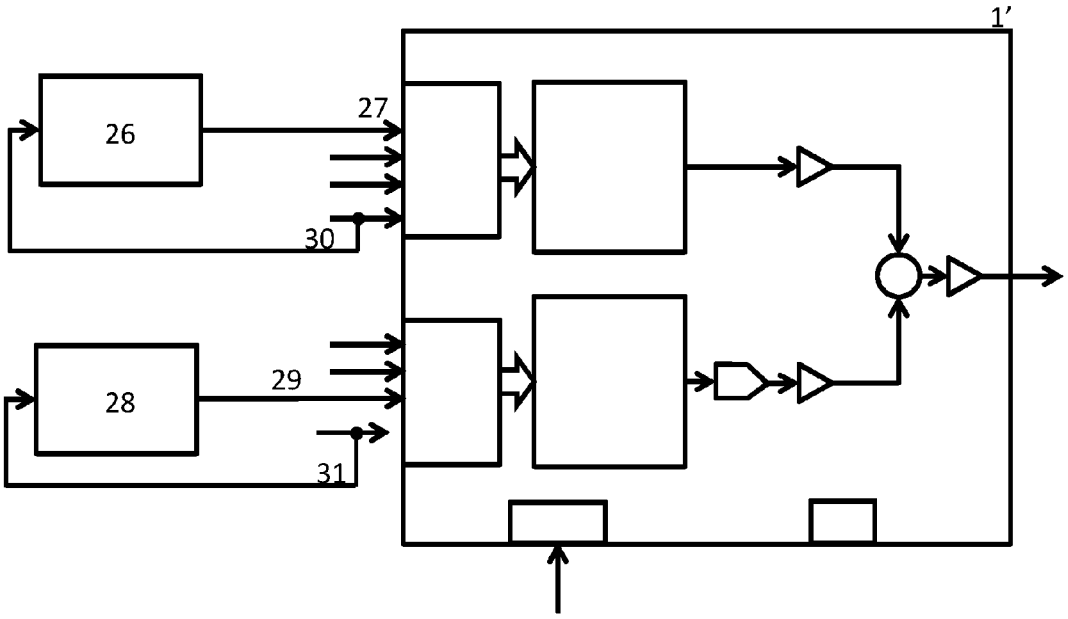
FIG. 2E is a schematic illustration of a fifth configuration of an ANR device formed from the unconfigured ANR device of FIG. 2.

FIG. 2E shows an alternative configuration in which the cost and complexity of providing dedicated outputs 24, 25 are replaced by allowing the application to tap off the connection to the relevant transducer. As illustrated in FIG. 2E remote analogue processor derives its input from a tap on the (otherwise unused) analogue input 30. Alternatively, a digital remote processor is shown tapping off an application circuit line 31, which is making no connection to the newly-disclosed device.

Figure 2F:
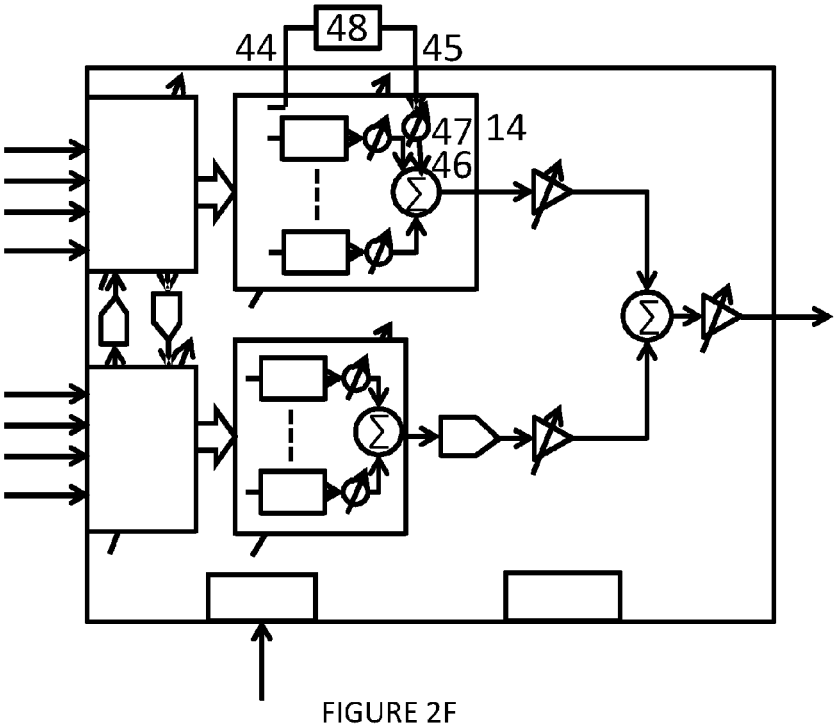
FIG. 2F is a schematic illustration of a sixth configuration of an ANR device formed from the unconfigured ANR device of FIG. 2.

FIG. 2F shows a further alternative configuration in which a further output 44 and an input 45 provide an expansion path to allow the analogue processor to be expanded by external processing resource 48. As illustrated, output 44 allows a signal received via switching array 12 to be passed to external processing resource 48. Input 45 allows external processing resource 48 to return a processed signal component 46 into the output of analogue processor 14 (this component may optionally be capable of scaling by a constant such as shown at 47 or more elaborate linear filtering). Such expansion of the architecture of the analogue processor is seen to result in a different overall transfer function than is possible by routing a signal to an external resource and then returning the processed result through the input matrix and thence through the processing resources as previously described.

A more detailed embodiment will now be described with reference to FIG. 3 and associated applications of the device illustrated in FIGS. 3A-D. These applications illustrate how the resources of not only the device alone, but all the resources of all devices in a system, can be shared so as to optimise performance with respect to application-critical parameters.

Figure 3:
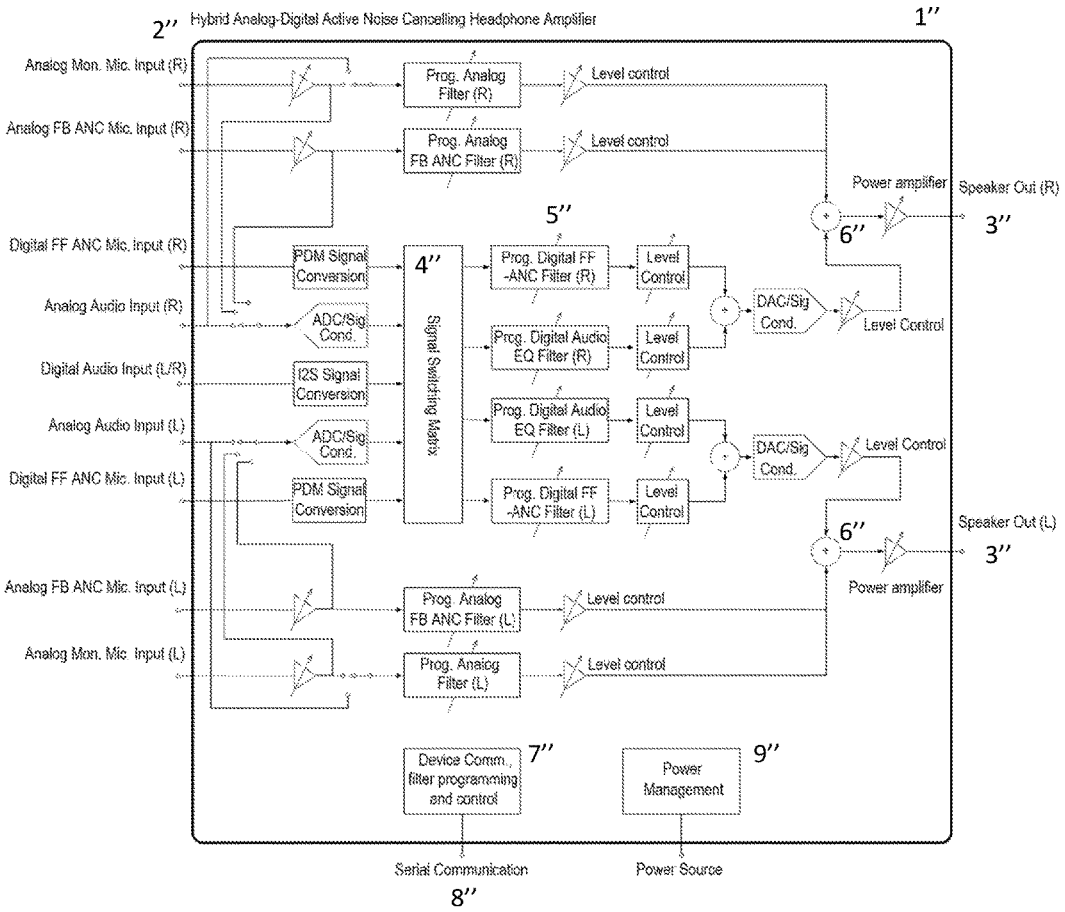
FIG. 3 is a schematic illustration of an ANR device accordance with a third embodiment prior to configuration during manufacture.

FIG. 3 illustrates an unconfigured ANR device 1" (based on ANR device 1—features in common are labelled accordingly) comprising two analogue and two digital filter paths, each of which is programmable, for each of two stereo/binaural channels. The filters are driven by a range of inputs, derived from analogue and digital microphone inputs and digital and analogue audio inputs.

Figure 3A:
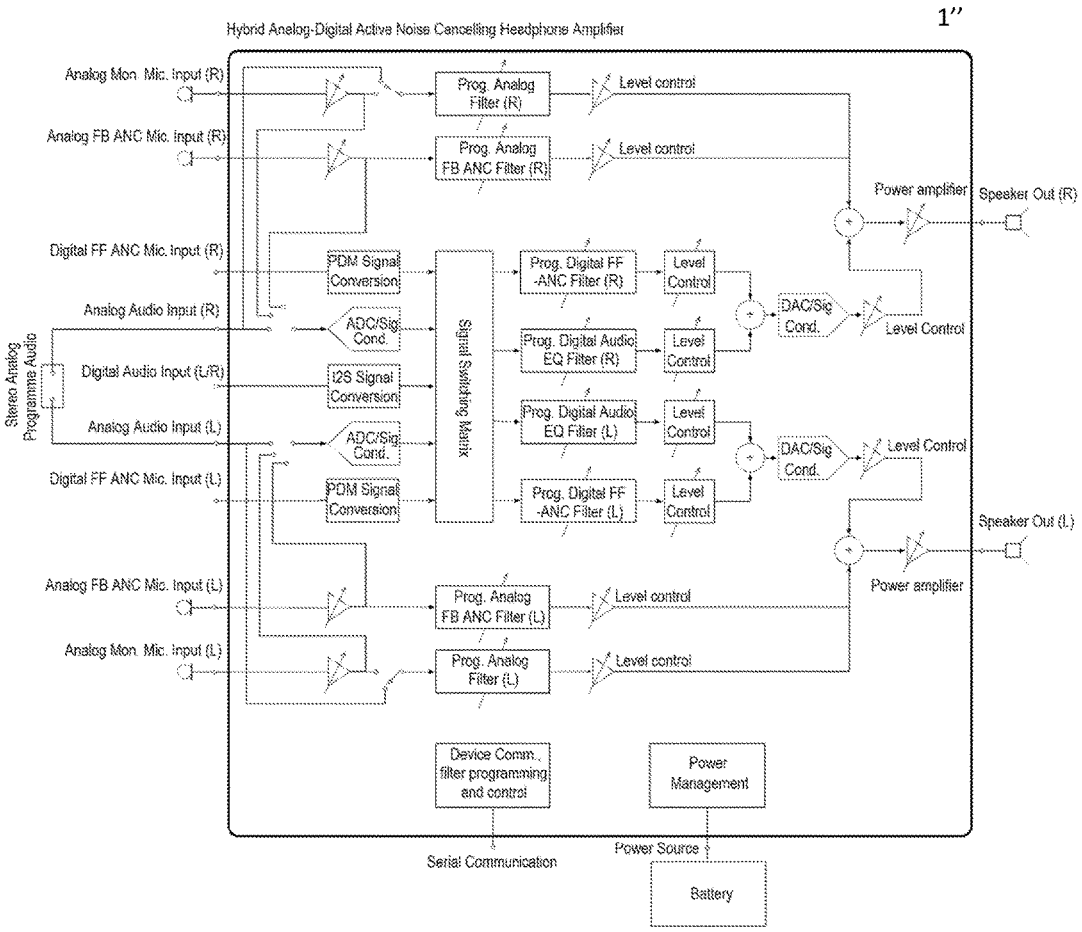
FIG. 3A is a schematic illustration of a first configuration of an ANR device formed from the unconfigured ANR device of FIG. 3.

In the simplest, low-power application, the system is configured during manufacture as shown at FIG. 3A, in which hybrid noise cancellation (i.e. feedforward and feedback) is delivered using low-power analogue microphone technologies allied with simple analogue filtering. Despite its significant advantages (of low noise, zero latency and low power consumption), the analogue filtering is able only to operate with relatively modest differential order, so it delivers only a limited degree of noise cancellation in some applications. The audio signal in FIG. 3A is fed into an analogue to digital converter and through the digital path for equalisation.

Figure 3B:
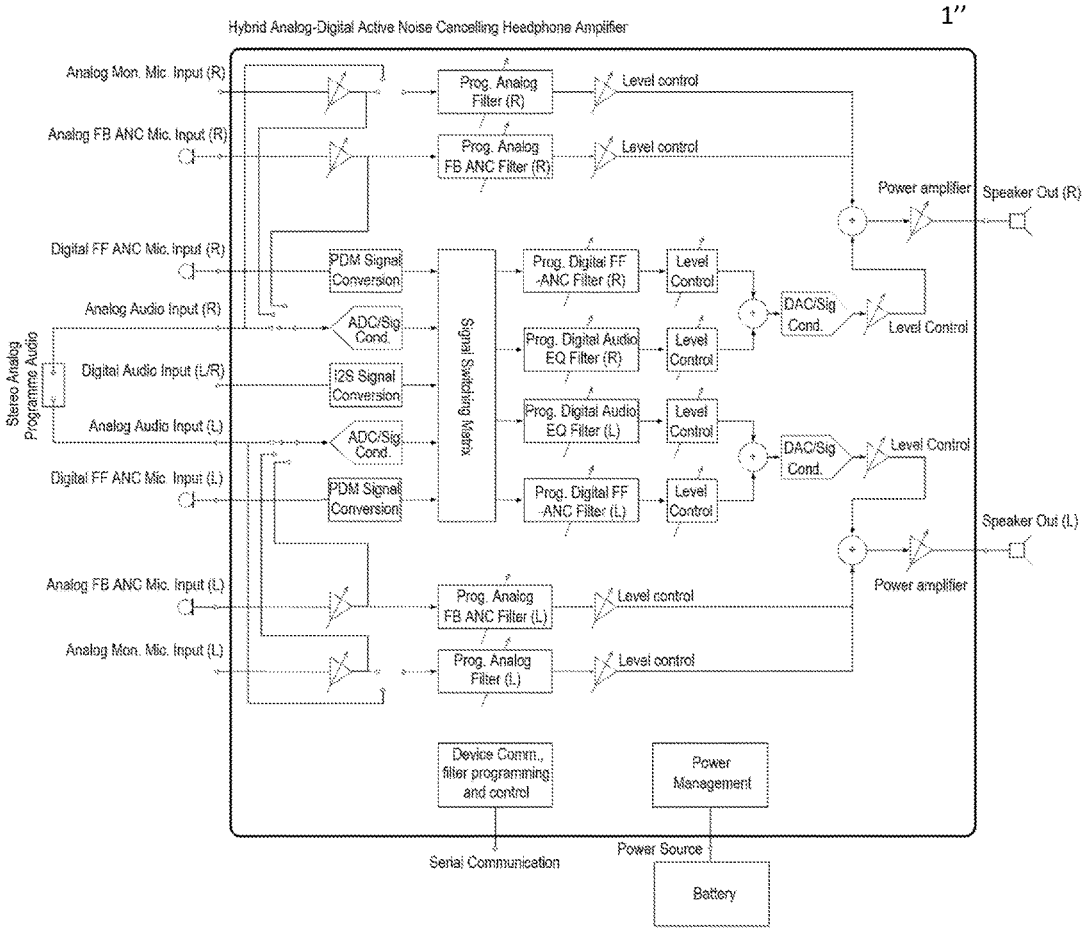
FIG. 3B is a schematic illustration of a second configuration of an ANR device formed from the unconfigured ANR device of FIG. 3.

In a more ambitious application for a wired, stand-alone headphone, the same device could be configured as shown at FIG. 3B, in which hybrid noise cancellation (i.e. feedforward and feedback) is delivered using digital microphone technology, allowing the feedforward filtering to be implemented using digital filtering means at higher digital order. This will usually result in a higher level of total noise cancelling performance at the expense of higher overall power consumption and higher component cost.

Figure 3C:
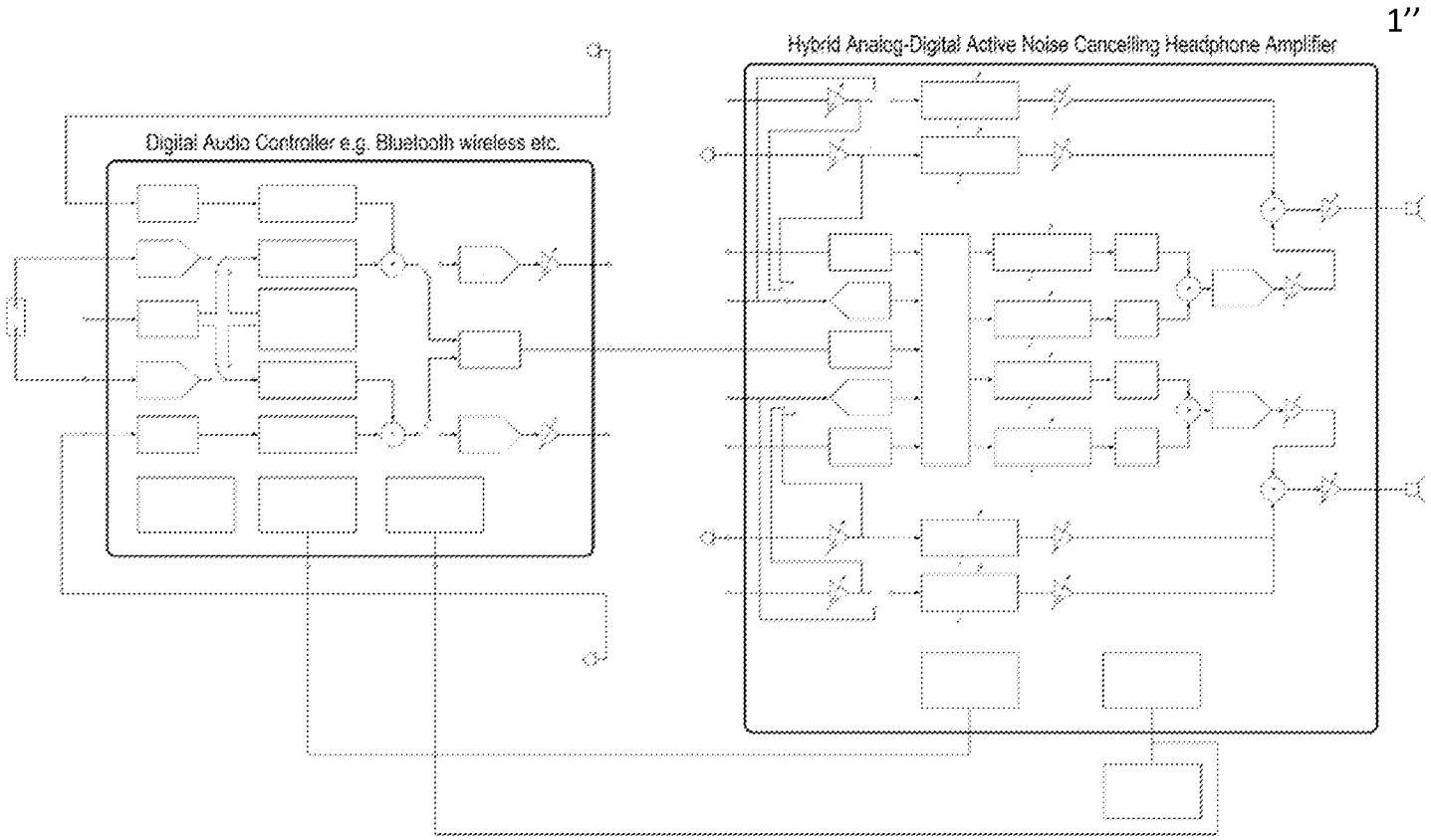
FIG. 3C is a schematic illustration of a third configuration of an ANR device formed from the unconfigured ANR device of FIG. 3.

In the case of a wireless headphone application optimised for power consumption, as shown in FIG. 3C, feedforward noise cancellation would be provided by signals applied to the inputs of the Digital Audio Controller and filtered by resources on that device, before being passed into the newly-disclosed component's digital audio input, along with digital program material. Feedback control would again be realised by analogue means.

Figure 3D:
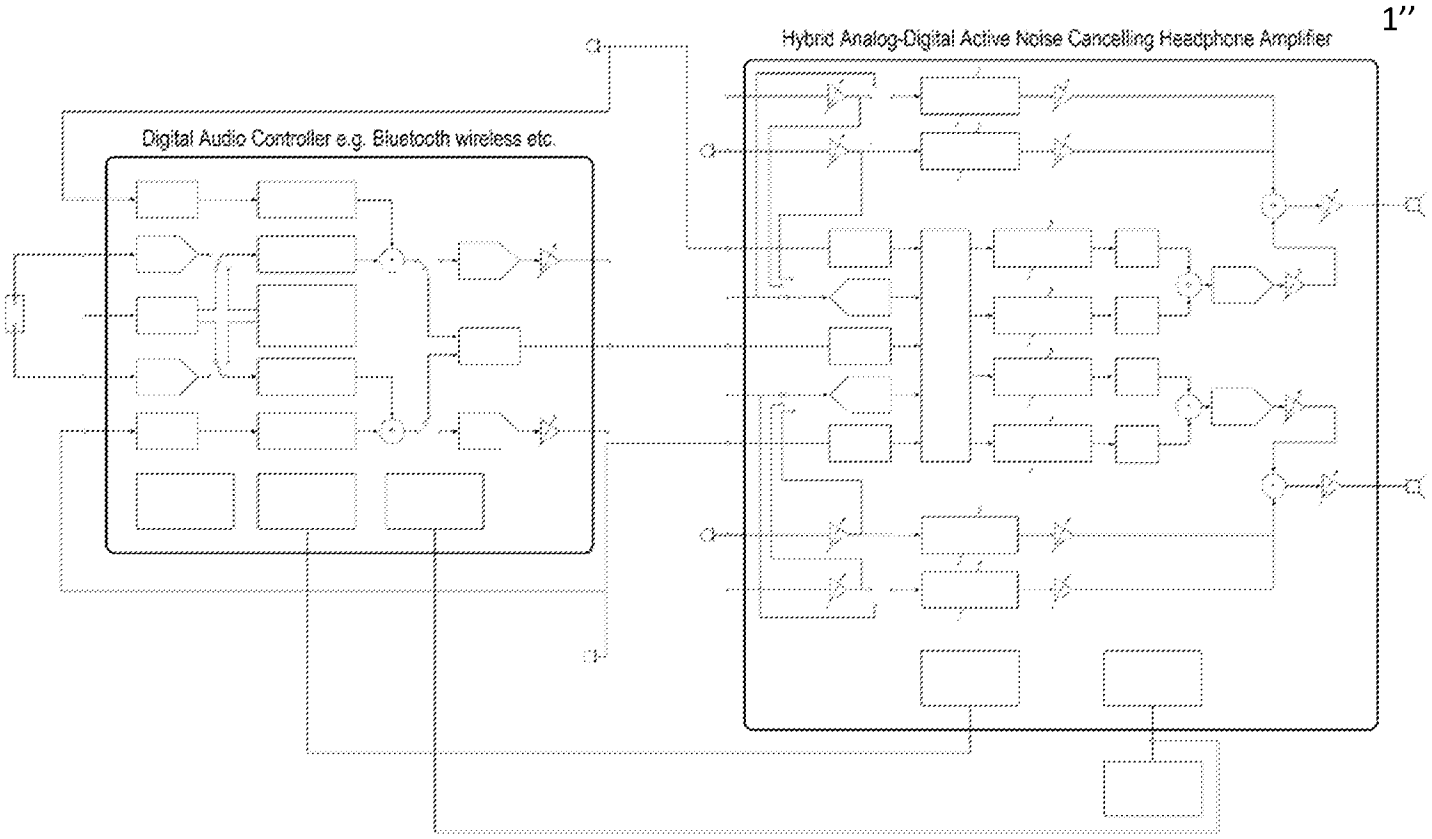
FIG. 3D is a schematic illustration of a fourth configuration of an ANR device formed from the unconfigured ANR device of FIG. 3.

In the case of a wireless headphone application optimised for noise cancelling performance, shown in FIG. 3D, feedforward noise cancellation would be generated by internal digital processing operations on signals obtained from a digital microphone. The same digital microphone's output would be shared by the Digital Audio Controller and filtered there to provide Monitoring (/"talk through") signals and/or sidetone signals for telephony.

The invention claimed is:

1. A method of manufacturing an Active Noise Reduction (ANR) device, comprising:

providing at a stage during manufacture a pre-completion ANR device in a non-final configuration, the pre-completion ANR device comprising:

a plurality of inputs;

a plurality of signal processing resources comprising:

a plurality of analogue signal processing resources; and a plurality of digital signal processing resources;

an output for driving an earphone driver; and a programmable switch arrangement capable of assigning any of the plurality of inputs to any of the plurality of signal processing resources;

selecting from the plurality of signal processing resources a subset of signal processing resources to contribute to the output, whereby the remaining signal processing resources of the plurality are unselected; and in a configuration step during manufacture, programming the programmable switch arrangement to assign each of at least a subset of the plurality of inputs to a different one of the selected subset of signal processing resources to enable the selected subset of signal processing resources to contribute to the output, whereby the unselected signal processing resources of the plurality of signal processing resources are configured not to contribute to the output in any mode of operation of the ANR device.

2. A method according to claim 1, wherein:

the plurality of inputs include:

a plurality of analogue inputs comprising at least two analogue microphone inputs and at least one analogue audio input; and a plurality of digital inputs comprising at least two digital microphone inputs and at least one digital audio input.

3. A method according to claim 2, wherein the method comprises manufacturing a plurality of different configurations of ANR device wherein:

for a first class of ANR device:

the selecting step comprises selecting one or more of the plurality of analogue signal processing resources to contribute to the output and one or more of the plurality of digital signal processing resources to not contribute to the output; and the configuration step comprises assigning a subset of the plurality of the analogue inputs to the selected one or more of the plurality of analogue signal processing resources; and for a second class of ANR device:

the selecting step comprises selecting one or more of the plurality of digital signal processing resources to contribute to the output and one or more of the plurality of analogue resources to not contribute to the output; and the configuration step comprises assigning a subset of the plurality of digital inputs to the selected one or more of the plurality of digital signal processing resources.

4. A method according to claim 3, wherein for the first class of ANR device the configuration step comprises assigning an analogue feedforward microphone input to a selected analogue signal processing resource and the selected analogue signal processing resource is configured to operate as a feedforward ANR filter.

5. A method according to claim 3, wherein for the first class of ANR device the configuration step comprises assigning an analogue feedback microphone input to a selected analogue signal processing resource and the selected analogue signal processing resource is configured to operate as a feedback ANR filter.

6. A method according to claim 3, wherein for the first class of ANR device the configuration step comprises assigning an analogue audio input to a selected analogue signal processing resource and the selected analogue signal processing resource is configured to operate as an equalisation filter.

7. A method according to claim 3, wherein for the second class of ANR device the configuration step comprises assigning a digital feedforward microphone input to a selected digital signal processing resource and the selected digital signal processing resource is configured to operate as a feedforward ANR filter.

8. A method according to claim 7, wherein the configuration step further comprises assigning an analogue feedback microphone input to a selected analogue signal processing resource and the selected analogue signal processing resource is configured to operate as a feedback ANR filter.

9. A method according to claim 3, wherein for the second class of ANR device the configuration step comprises assigning a digital audio input to a selected digital signal processing resource and the selected digital signal processing resource is configured to operate as an equalisation filter.

10. A method according to claim 1, wherein the method further comprises configuring the ANR device to power down or reduce power to signal processing resources that are not selected to contribute to the output.

11. A method according to claim 1, wherein the ANR device is operative to provide a resource sharing output signal to an external device operative to provide an external signal processing resource.

12. A method according to claim 11, wherein the programmable switch arrangement is operative to provide the resource sharing output signal to the external device.

13. A method according claim 12, wherein the resource sharing output signal is provided is via a dedicated output.

14. A method according to claim 12, wherein the resource sharing output signal is provided using one of the plurality of inputs.

15. A method according to claim 14, wherein the programmable switch arrangement is programmable to assign one or more of the plurality of inputs as an output for the resource sharing output signal.

16. A method according to claim 11, wherein the plurality of signal processing resources is expandable to include an external signal processing resource assignable to an input by the programmable switch arrangement.

17. An Active Noise Reduction (ANR) device comprising:

a plurality of inputs;

a plurality of signal processing resources;

an output for driving an earphone driver;

a programmable switch arrangement capable of assigning any of the plurality of inputs to any of the plurality of signal processing resources; and a controller for programming the programmable switch arrangement in order to assign each of at least a subset of the plurality of inputs to a different one of the signal processing resources;

wherein:

the plurality of signal processing resources comprises a plurality of filters, the plurality of filters including:

a plurality of analogue filters; and a plurality of digital filters;

wherein the ANR device is configured such that only a subset of signal processing resources is selected during manufacture to contribute to the output and the remaining signal processing resources of the plurality do not contribute to the output in any mode of operation of the ANR device.

18. An ANR device according to claim 17, wherein the ANR device is dynamically configurable to vary which signal processing resources are selected from the subset of signal processing resources selected during manufacture to contribute to the output.

19. An ANR device according to claim 17, wherein the ANR device is dynamically configurable so as to minimise a "figure-of-merit" or "cost-function" parameter.

20. An ANR device according to claim 17, wherein:

the plurality of inputs include:

a plurality of analogue inputs comprising at least two analogue microphone inputs and at least one analogue audio input; and a plurality of digital inputs comprising at least two digital microphone inputs and at least one digital audio input.

21. An ANR device according to claim 20, wherein the ANR device is configured such that one or more of the plurality of analogue signal processing resources contribute to the output and one or more of the plurality of digital signal processing resources do not contribute to the output, whereby a subset of the plurality of the analogue inputs are assigned to the selected one or more of the plurality of analogue signal processing resources.

22. An ANR device according to claim 21, wherein the selected analogue signal processing resource is configured as a feedforward ANR filter and the assigned input is an analogue feedforward microphone input.

23. An ANR device according to claim 21, wherein the selected analogue signal processing resource is configured as an analogue feedback ANR filter and the assigned input is an analogue feedback microphone input.

24. An ANR device according to claim 21, wherein the selected analogue signal processing resource is configured as an equalisation filter and the assigned input is an analogue audio input.

25. An ANR device according to claim 21, wherein one or more of the plurality of digital signal processing resources contribute to the output and one or more of the plurality of analogue resources do not contribute to the output, whereby a subset of the plurality of digital inputs are assigned to the selected one or more of the plurality of digital signal processing resources.

26. An ANR device according to claim 25, wherein the selected digital signal processing resource is configured as a feedforward ANR filter and the assigned input is a digital feedforward microphone input.

27. An ANR device according to claim 26, wherein there is further selected an analogue signal processing resource configured as an analogue feedback ANR filter and assigned to an analogue feedback microphone input.

28. An ANR device according to claim 25, wherein the selected digital signal processing resource is configured as an equalisation filter and the assigned input is a digital audio input.

29. An ANR device according to claim 17, wherein the ANR device is configured to power down or reduce power to signal processing resources that are not selected to contribute to the output.

30. An ANR device according to claim 17, wherein the ANR device is operative to provide a resource sharing output signal to an external device operative to provide an external signal processing resource.

31. An ANR device according to claim 30, wherein the programmable switch arrangement is operative to provide the resource sharing output signal to the external device.

32. An ANR device according to claim 31, wherein the resource sharing output signal is provided is via a dedicated output.

33. An ANR device according to claim 31, wherein the resource sharing output signal is provided using one of the plurality of inputs.

34. An ANR device according to claim 33, wherein the programmable switch arrangement is programmable to assign one or more of the plurality of inputs as an output for the resource sharing output signal.

35. An ANR device according to claim 30, wherein the plurality of signal processing resources is expandable to include an external signal processing resource assignable to an input by the programmable switch arrangement.

* * * * *